United States Patent [19]

Grangette et al.

[11] 4,396,400

[45] Aug. 2, 1983

[54] PROCESS FOR IMPROVING THE COMBUSTION OF GAS OILS

[75] Inventors: Henri Grangette, Lyons; Jean Bouvier, Saint Maurice l'Exil, both of France

[73] Assignee: Societe Elf France, France

[21] Appl. No.: 254,048

[22] Filed: Apr. 14, 1981

[30] Foreign Application Priority Data

Apr. 16, 1980 [FR] France ..... 80 08546

[51] Int. Cl.[3] ..... C10L 1/22; C10L 1/24

[52] U.S. Cl. ..... 44/75; 44/51; 44/57; 44/72; 44/76

[58] Field of Search ..... 44/51, 57, 75, 72; 252/34.6

[56] References Cited

U.S. PATENT DOCUMENTS

| | | | |
|---|---|---|---|
| 3,317,291 | 5/1967 | Marsh et al. | 44/75 |
| 3,876,391 | 4/1975 | McCoy et al. | 44/51 |
| 3,902,869 | 9/1975 | Fribey et al. | 44/51 |

*Primary Examiner*—Jacqueline V. Howard

*Attorney, Agent, or Firm*—Ostrolenk, Faber, Gerb & Soffen

[57] ABSTRACT

This process consists in adding to gas oil from 100 to 5000 ppm of water in the form of a micellar clear and limped solution, which is stable for long times, obtained by the addition of one or more surfactants, associated with one or more auxiliary surface-active agents (co-surfactants). This invention substantially improves the combustion of gas oils.

18 Claims, No Drawings

PROCESS FOR IMPROVING THE COMBUSTION OF GAS OILS

DESCRIPTION

This invention relates to a process of improvement of the properties of combustion of gas oils by the addition to the gas oil of appropriate quantities of water and one or more surfactants, associated if required with one or more co-surfactants, the latter being compounds capable of forming hydrogen bonds with water. The gas oil treated according to the invention has a completely clear and limpid appearance, the water being completely solubilized and not separating.

It is known to utilize organometallic salts of $Ca^{++}$, $Ba^{++}$, $Fe^{+++}$ and others to improve the combustion of gas oils. Such additives, incorporated in gas oils in amounts of the order of 10 to 1000 ppm, allow reduction in the emission of soot, solid residues, CO and combusted hydrocarbons, by initiating the formation of free radicals. However, these additives have a certain number of disadvantages, notably toxic emissions at the exhaust point, particularly in the case of salts of $Ba^{++}$, and in general formation in combustion chambers of metal oxides which can exert an abrasive action.

The beneficial effect of water on the combustion of hydrocarbons is known. For instance, it was proposed in 1954, in French Patent Specification No. 1100551, to incorporate into liquid fuels small quantities of water in the presence of emulsifying agents, for example condensation products of fatty alcohols, phenols or fatty acids with ethyl oxide. However, in practice, stable emulsions are not obtained and the incorporated water separates with time, leading to disadvantages in storage reservoirs, such as corrosion and bacterial growth. Moreover, the water droplets become entrained in filters and cause swelling and distortion, yielding unexpected blockages of the supply from the reservoir, clogging of pumps, etc. The presence of drops of water causes the formation of ice crystals in cold weather, giving frosting and blockage of the filters in the supply circuit to the engine.

More recently, attempts have been made to remedy deficiences of the prior art, by the utilization of special mixtures of surfactant compounds, thus giving stable emulsions containing water in the form of very fine particles dispersed in the hydrocarbon. For instance, U.S. Pat. No. 3,876,391 describes the incorporation of 6% to 16% of water into motor fuel in the presence of 3% to 8% of a fatty acid ester, possibly polyethoxylated, and including an amine, polyethoxylated alkylphenol, polyethoxylated fatty acid amide or polyethoxylated sorbitol fatty ester surfactant; moreover, it is necessary to add 0.5% to 10% of a water-soluble amide or amine, for example, acetamide, formamide, monoethanolamine, ethylene-diamine etc. The proposed solution is thus notably complex.

The problem has thus remained complicated throughout recent years, as can be seen from U.S. Pat. No. 4,083,698, which still recommends mixtures of fatty acid salts with non-ionic polyethoxylated surfactants, in order to obtain very fine stable emulsions containing 0.1% to 10% of water and 1% to 10% of a lower alcohol in a fuel. When the latter is relatively heavy, in particular a diesel fuel, that is to say a gas oil, the proposed combination is no longer generally sufficient and the patent explains (columns 24 and 25) that it is necessary to add up to about 15% of cyclohexanol and/or cyclohexanone.

The present invention provides a marked improvement in this technique in that it permits a considerable improvement in the combustion of fuels of the gas ol type, that is to say hydrocarbons boiling between about 200° and 425° C., in a particularly simpler and more economical manner, which can be more readily carried out than the known technique.

This invention results from two unexpected discoveries: 1. The desired improvement of a gas oil can be obtained by the incorporation of low proportions of water, namely from 0.01% to 0.5%, contrary to the several percent utilized in the prior art; 2. the water is capable of being put into an emulsion which is completely clear and very stable by means of certain specific surfactant compounds, which have never been employed for this purpose in the past.

The new process according to the invention, which consists in emulsifying 100 to 5000 parts per million of water in gas oil in the presence of a surfactant, is characterized in that the surfactant is constituted by one or more compounds of the formula:

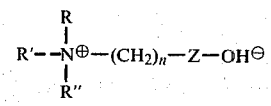

(1)

where Z represents CO or $SO_2$, n is an integral number from 1 to 6, R is an alkyl group or a hydrogen atom, R′ is an alkyl or alkenyl group, a hydrogen atom or an acyl group, while R″ can be a methyl group, but can also be absent.

When R is an alkyl group, it contains 1 to 30 carbon atoms and preferably 1 to 4. If R′ is an alkyl or alkenyl group, it can contain 1 to 30 carbon atoms, preferably 1 to 18. If R′ is an acyl group, $R^{IV}$—CO—, its number of carbon atoms generally is from 2 to 18, that is to say $R^{IV}$ is $C_1$ to $C_{17}$; preferably, $R^{IV}$ is a $C_5$ to $C_{17}$ aliphatic chain.

In one embodiment of the invention, the surfactant compounds according to formula (1) are N-alkyl-dimethyl-glycines or N-alkenyl-dimethyl-glycines, namely betain derivatives in which R and R″ are methyl groups, R′ is a $C_6$ to $C_{18}$ and, preferably, a $C_{10}$ to $C_{18}$ aliphatic chain, n is 1 and Z represents CO. These agents can be represented by the formula:

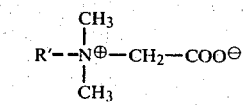

(2)

In particular, R′ is a decyl, undecyl, dodecyl, tetradecyl, hexadecyl, octadecyl or octadecenyl group. The amphoteric compounds (2) can be employed in the form of salts of anions connected to the

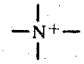

or cations combined with —$COO^-$; the cations can for example be alkali metals, ammonium or amines.

According to another embodiment, the compounds of formula (2) carry a sulphonic group $—SO_3^{\ominus}$ in place of $—COO^{\ominus}$.

The surfactant agents according to the invention can also be constituted by taurine $$H_2N—CH_2CH_2—SO_3H \quad (3)$$

or by a salt of this compound attached to the $NH_2$ or the $SO_3H$ group.

Another important series of surfactant agents for carrying out the invention comprises compounds of the formula (1), in which R' is an aliphatic acyl group, $R^{IV}$—CO, while R'' is absent. R is preferably $C_1$ to $C_4$. Typical products of this series are the N-acyl sarcosinates of alkali metals (M).

$$\begin{array}{l} CH_3—N—CH_2—COOM \\ \quad\quad\;\; | \\ \quad\quad\;\; C{=}O \\ \quad\quad\;\; | \\ \quad\quad\;\; R^{IV} \end{array} \quad (4)$$

Preferably, the $$\begin{array}{l} R^{IV}—C{=}O \\ \quad\quad\;\; | \end{array}$$

acyl group is derived from a $C_6$ to $C_{18}$ fatty acid, particularly caproic, caprylic, capric, lauric, myristic, palmitic or stearic or, if required, unsaturated acids, such as oleic, linoleic or linolenic acids.

It is advantageous to employ the agents (4) in the form of mixtures comprising acyl groups having different numbers of carbon atoms, corresponding to several fatty acids derived from a natural oil or grease. For example, using coprah (coco) oil, a mixture of compounds (4) where the $R^{IV}CO$ groups are $C_8$, $C_{10}$, $C_{12}$, $C_{14}$, $C_{16}$ and $C_{18}$ (oleic), with lauric (approximately 44%) and myristic (approximately 18%) acyl groups predominating, can be used.

Preferably, the invention is carried out by also employing a co-surfactant of a type known per se for this kind of emulsion, for example an alcohol, an amine or an amide. Lower alcohols, such as methanol, ethanol, propanol, isopropanol and the butanols, are generally very suitable.

The proportion of co-surfactant, like the surfactant itself, is of the order of 10 to 5000 ppm and particularly 25 to 2000 ppm or 0.0025% to 0.2% of the gas oil. Depending on the choice made, the weight of the co-surfactant is generally from 0.1 to 1 part, usually 0.5 to 1 part, per 1 part of the surfactant by weight.

The quantity of the surfactant utilized is proportional to the quantity of water to be solubilized. In a general manner, aromatic gas oils having an aromatic content higher than 25% require smaller quantities of surfactant than paraffinic gas oils having an aromatic content of the order of 10% to 15%.

The addition of the surfactant, if required in association with the co-surfactant, allows the water/gas oil interfacial tension to be substantially diminished by a value of the order of 30 to 40 dynes $cm^{+1}$.

The system obtained has the form of a liquid dispersion in which the continuous external phase is the gas oil, while the disperse phase is constituted by the water in droplets or spherules having a diameter lower than 0.4 micron. The entire dispersion has an appearance which is transparent to light. The system formed is thermodynamically stable and, contrary to known emulsions, the water does not separate, even after a very long time of the order of several months.

In a general manner, the process of the invention is carried out by the addition to the gas oil of 100 to 5000 ppm of water, 10 to 5000 ppm of the surfactant, and a quantity of co-surfactant compound, the weight ratio of the latter to the surfactant being from 0.1 to 1. However, very good results can be obtained with 100 to 1000 ppm of water and 25 to 2000 ppm of the surfactant, accompanied by 0.5 to 1 part by weight of the co-surfactant compound.

The non-limitative examples which follow illustrate the invention in various forms with specific surfactants.

In these examples, a diesel engine was operated with gas oil containing no additive and, on the other hand, with gas oils treated according to the invention.

A gas oil was used having the following characteristics:

| | |
|---|---|
| relative density at 15° C. with respect to water at 4° C. | 0.831 |
| 50% distillation point | 255° C. |
| 90% distillation point | 363° C. |
| Final distillation point | 340° C. |
| Viscosity at 20° C. | 4.1 cst |
| Initial water content | 75 ppm |

The water utilized was de-mineralised.

The vehicle employed for the tests was placed on a dynamometric chassis. The location in which the tests were to be carried out was climatically controlled, such that it was possible to place it under completely known and reproducible conditions (20° C.). The procedure began with a first stage having a test time of 45 mins., at a stabilized speed, the engine operating at two-thirds of its nominal power output. The vehicle tank contained the gas oil for the tests. The tests were carried out when a good thermal equilibrium of the engine had been obtained.

A substantially similar operative mode had also been carried out on an engine on a test bench.

The tests were conducted in accordance with the conditions of the Journal Officiel de la République Francaise for the registration of vehicles by the EEC, namely:

Tests at constant speed: with the engine being supplied with plain fuel, the measurements effected were divided in a uniform manner between a regime corresponding to the maximum power of the engine and the greater of the following regimes: (1) 45% of the rate of rotation corresponding to maximum power and (2) 1000 revs per minute.

Free acceleration tests: the gearbox of the engine was placed in neutral and the engine was connected up; with the engine turning slowly, its accelerator was operated rapidly but carefully, in such a manner as to obtain the maximum throughput of the injection pump; this position was maintained until the governor operated; when this speed was obtained, the accelerator was relaxed until the engine resumed its slow speed.

The operation was repeated at least six times in order to sparge the exhaust system and, where necessary, the apparatus was then calibrated.

The measurements consisted in determining the opacity of the fumes recovered from the vehicle exhaust.

The apparatus used was an opacimeter of the type and mode of utilization conforming to the description published in the Journal Officiel de la République Francaise of Mar. 21, 1974, Annexes 7 and 8.

The test vehicle was equipped with a 3.3 liter capacity engine developing a power of 56 Kw at 3200 revs per min.

EXAMPLES 1 TO 7

Tests on the engine stabilized at 1500, 2000, 2500 and 3200 revs per min. were effected, on the one hand with the gas oil without additive and on the other hand with the various additives indicated in the results Table I.

The latter are expressed as the coefficients of absorption in $m^{-1}$ found for the exhaust gases, following measurement of the opacity mentioned above.

Each result is the average of 4 determinations, the variation not exceeding 5%. The percentage reduction of the absorption coefficient is designated as "improvement", in each case, with respect to the coefficient found for the gas oil not containing any additive. Thus in the column for 1500 revs per min. in Table I, between Examples 1 and 2, the improvement of 17.5% results from the calculation $100\times(1.94-1.60):1.94=34:1.94=17.5\%$.

The surfactant agent utilized in Examples 2 to 4 is constituted by a mixture of sodium N-acyl-sarcosinates of the formula (4) given above, which contain acyl groups $R^{IV}$—CO derived from coprah (coco) oil fatty acids.

By way of comparison, tests were also effected with, as additives, barium sulphonate (Examples 5 and 6) and a standard surfactant based on polyoxyethylated alcohols (UKANIL 36 manufactured by Societe Pechiney-Ugine-Kuhlmann).

TABLE I

| No | Additive | | Coefficients of absorption (C) in $m^{-1}$ and % improvement (A) 1500 r/m C | 1500 r/m A | 2000 r/m C | 2000 r/m A | 2500 r/m C | 2500 r/m A | 3200 r/m C | 3200 r/m A |
|---|---|---|---|---|---|---|---|---|---|---|
| 1 | None | | 1.94 | | 1.47 | | 2.61 | | 4.45 | |
| 2 | Sarcosinate | 25 ppm | | | | | | | | |
| | Water | 100 ppm | 1.60 | | 0.90 | | 1.80 | | 3.60 | |
| | Butanol-2 | 25 ppm | | | | | | | | |
| | Improvement | | | 17.5% | | 38.8% | | 31% | | 19.1% |
| 3 | Sarcosinate | 500 ppm | | | | | | | | |
| | Water | 1000 ppm | 1.50 | | 1.10 | | 1.75 | | 2.90 | |
| | Butanol-2 | 500 ppm | | | | | | | | |
| | Improvement | | | 22.7% | | 25% | | 33% | | 34.8% |
| 4 | Sarcosinate | 2000 ppm | | | | | | | | |
| | Water | 5000 ppm | 1.55 | | 1.00 | | 1.90 | | 3.25 | |
| | Butanol-2 | 2000 ppm | | | | | | | | |
| | Improvement | | | 20% | | 32% | | 27.2% | | 27% |
| 5 | Ba Sulphonate | 50 ppm | 1.45 | | 1.00 | | 2.00 | | 4.1 | |
| | Improvement | | | 25.2% | | 32% | | 23.3% | | 7.8% |
| 6 | Ba Sulphonate | 100 ppm | 1.40 | | 0.95 | | 1.50 | | 3.50 | |
| | Improvement | | | 27.8% | | 35.4% | | 42.5% | | 21.3% |
| 7 | Polyoxyeth. alcohols | 600 ppm | | | | | | | | |
| | Water | 1000 ppm | 1.70 | | 1.35 | | 2.20 | | 3.70 | |
| | Butanol-2 | 600 ppm | | | | | | | | |
| | Improvement | | | 12.3% | | 8.2% | | 15.7% | | 16.8% |

The overall average improvements in percentage thus were:

26.6% for the sarcosinate of Example 2
28.8% for the sarcosinate of Example 3
25.3% for the sarcosinate of Example 4
22.0% for 50 ppm of sarcosinate of Example 5
31.0% for 100 ppm of sarcosinate of Example 6
13.2% for the polyoxyethylated alcohols -continued of example 7

It will be seen that the sarcosinate gives results comparable with those obtained with the organic barium compound, without giving the disadvantages, and better than those of polyoxyethylated alcohols utilised in the prior art.

It also appears in the light of Examples 2 to 4 that 1000 ppm of water can suffice to give an optimum overall improvement.

EXAMPLES 8 TO 12

Free acceleration tests.

The same sarcosinate as in the foregoing Examples 2 to 4 was tested.

TABLE II

| No | Additive | | Coefficient of absorption in $m^{-1}$ with additive | Control test without additive | Improvement |
|---|---|---|---|---|---|
| 8 | Sarcosinate | 500 ppm | 0.95 | 1.18 | 19.5% |
| | Water | 1000 ppm | | | |
| | Butanol-2 | 500 ppm | | | |
| 9 | Sarcosinate | 2000 ppm | 0.80 | 1.16 | 31.0% |
| | Water | 5000 ppm | | | |
| | Butanol-2 | 2000 ppm | | | |
| 10 | Diethyl-Ba | 50 ppm | 0.94 | 1.22 | 22.9% |
| 11 | Diethyl-Ba | 100 ppm | 0.79 | 1.39 | 43.1% |
| 12 | Polyoxyethylene alcohols (UKANIL 36) | 600 ppm | 1.01 | 1.09 | 7.4% |

It can be seen that at the same free acceleration, the improvements due to the sarcosinates are of the same order as those due to barium sulphonate and higher than those given with polyoxyethylated alcohols.

EXAMPLES 13 AND 14

In the manner described in connection with Examples 1 to 7, using a stabilized regime, gas oils containing water were tested in the presence of N-lauryl-dimethyl-glycine, that is to say a betain corresponding to formula (2) given above where R′ is a dodecyl group. To calculate the improvements, the figures of Example 1 relating to the gas oil without additive are repeated in Table III.

TABLE III

| No | Additive | | Coefficients of absorption (C) in $m^{-1}$ and % improvements (A) 1500 r/m C | 1500 r/m A | 2000 r/m C | 2000 r/m A | 2500 r/m C | 2500 r/m A | 3200 r/m C | 3200 r/m A |
|---|---|---|---|---|---|---|---|---|---|---|
| 1 | None | | 1.94 | | 1.47 | | 2.61 | | 4.45 | |
| 13 | Betain | 500 ppm | | | | | | | | |
| | Water | 1000 ppm | 1.60 | | 1.30 | | 1.80 | | 3.40 | |
| | Butanol-2 | 500 ppm | | | | | | | | |
| | Improvement | | | 17.5% | | 11.5% | | 31% | | 23.6% |
| 14 | Betain | 2000 ppm | | | | | | | | |
| | Water | 5000 ppm | 1.35 | | 0.80 | | 1.30 | | 2.90 | |
| | 3-Methyl butanol-1 | 2000 ppm | | | | | | | | |
| | Improvement | | | 30.4% | | 45.5% | | 50% | | 34.8% |

The overall average improvements amount to 20.9% for Example 13 and 40% for Example 14. Comparison with Table I shows that, for 500 ppm of surfactant and 1000 ppm of water, the sarcosinate is more effective than the betain, while at a rate of 2000 ppm of surfactant and 5000 ppm of water, in contrast, the betain gives the better results. Thus, the invention allows a choice of the most appropriate emulsifying agent depending upon the proportion of water to be incorporated into the gas oil. The combined use of a sarcosinate with a betain is also recommendable.

EXAMPLES 15 AND 16

The surfactant, N-lauryl-dimethyl-glycine, of Examples 13 and 14 was tested under free acceleration, in parallel to control tests with the same untreated gas oil. The following absorption in $m^{-1}$ were found:

| | Example 13 | Example 14 |
|---|---|---|
| treated gas oil: | 0.98 | 0.90 |
| Gas oil without additive: | 1.21 | 1.17 |
| improvement | 19% | 23% |

In the following Examples, the surfactants employed are compounds of formula (3), in which the $NH_2$ group is replaced by an aliphatic or alkaryl hydrocarbon chain, which can carry carboxylic groups, in particular sulpho-succinic groups. THe sulpho group in these compounds is neutralized by an alkaline or nitrogen-containing base.

EXAMPLES 17 TO 19

The surfactant employed is a sodium alkyl-aryl-benzene-sulphonate of the sodium lauryl-benzene-sulphonate type, known commercially under the name SYNACTO 406, produced by Esso. The results are given in Table IV.

TABLE IV

| No | Additive | | Coefficients of absorption (C) in $m^{-1}$ and % improvements (A) 1500 r/m C | 1500 r/m A | 2000 r/m C | 2000 r/m A | 2500 r/m C | 2500 r/m A | 3200 r/m C | 3200 r/m A |
|---|---|---|---|---|---|---|---|---|---|---|
| 1 | None | | 1.94 | | 1.47 | | 2.61 | | 4.45 | |
| 17 | SYNACTO | 25 ppm | | | | | | | | |
| | Water | 100 ppm | 1.20 | | 0.9 | | 1.90 | | 3.7 | |
| | isopropanol | .25 ppm | | | | | | | | |
| | Improvement | | | 38% | | 39.4% | | 27.2% | | 16.9% |
| 18 | SYNACTO | 500 ppm | | | | | | | | |
| | Water | 1000 ppm | 1.45 | | 1.00 | | 2.05 | | 3.40 | |
| | isopropanol | 500 ppm | | | | | | | | |
| | Improvement | | | 25.2% | | 32% | | 21.3% | | 23.6% |
| 19 | SYNACTO | 3000 ppm | | | | | | | | |
| | Water | 5000 ppm | 1.20 | | 0.80 | | 1.85 | | 3.30 | |
| | isopropanol | 2000 ppm | | | | | | | | |
| | Improvement | | | 38% | | 45.5% | | 29% | | 25.8% |

EXAMPLES 20 TO 21

The same gas oils treated as in Examples 17 to 19, that is to say with a sodium alkyl-aryl-sulphonate surfactant, were tested under free acceleration. The following results were found:

| Gas oil treated according to example | 17 | 18 | 19 |
|---|---|---|---|
| Coefficient of absorption | 0.86 | 0.90 | 0.80 |
| Coefficient of gas oil without additive | 1.27 | 1.12 | 1.17 |
| Improvement | 0.41 | 0.22 | 0.37 |
| = | 32.3% | 19.6% | 31.6% |

EXAMPLE 22

Tests under stabilized regimes were effected with a gas oil in which 1000 ppm of water and 500 ppm of isobutanol had been emulsified with the aid of 500 ppm of a surfactant constituted by petroleum sulphonates known under the names PETROSTEP 465 (55%) and PETROSTEP 500 (45%) sold by Stepan.

The results obtained were:

| Regime Revs/min | Coefficients of absorption: Gas oil without additive | Gas oil according to the invention | Improvement |
|---|---|---|---|
| 1500 | 1.94 | 1.50 | 22.6% |
| 2000 | 1.47 | 1.10 | 25.2% |
| 2500 | 2.61 | 2.10 | 19.5% |
| 3200 | 4.45 | 3.80 | 14.6% |
| | | Average | 20.5% |

EXAMPLE 23

On replacing the Petrostep sulphonates in Example 22 by a mixture of two other petroleum hydrocarbon sulphonates, sold under the respective marks TRS 16 (70%) and TRS 18 (30%) by Witco, the following improvements were found under the same conditions:

| | |
|---|---|
| | 17.5% |
| | 32.0% |
| | 29.0% |
| | 19.1% |
| average | 24.4% |

Under free acceleration, the same gas oil gave an improvement of 20.6%.

We claim:

1. Process for improving the combustion of a gas oil comprising incorporating into said fuel from 100 to 5000 ppm of water in conjunction with at least one surfactant of the formula:

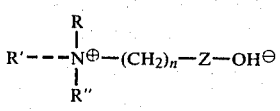

wherein Z represents CO or $SO_2$, n is an integral number from 1 to 6, R is an alkyl group or a hydrogen atom, R′ is an alkyl or alkenyl group, a hydrogen atom or an acyl group, while R″ is methyl or is absent, or a salt thereof.

2. Process according to claim 1, characterized in that R is a $C_1$ to $C_{30}$ alkyl group.

3. Process according to claim 1 or 2, characterized in that R′ is a $C_1$ to $C_{30}$ alkyl or alkenyl group.

4. Process according to claim 1 or 2, characterized in that R′ is an aliphatic acyl group containing 2 to 18 carbon atoms.

5. Process according to claim 3, characterized in that R and R″ are methyl groups, while R′ is a $C_6$ to $C_{18}$ aliphatic chain, the compound being an N-alkyl (or N-alkenyl) dimethyl-glycine.

6. Process according to claim 4, characterized in that R is a methyl group, R″ is absent and the group —ZOH is an alkali metal carboxylate the compound thus being an N-acyl sarcosinate of the alkali metal.

7. Process according to claim 1 or 2 characterized in that the surfactant is accompanied by an amine, an amide or an alcohol co-surfactant.

8. Process according to claim 1 or 2 characterized in that the water dispersed in the gas oil is in particles of dimensions below 0.4 micron.

9. Process according to claim 7, characterized in that the water incorporated into the gas ol is accompanied by the surfactant in the proportion of 10 to 5000 ppm with respect to the gas oil, and 0.1 to 1 part by weight of co-surfactant being present per part of surfactant.

10. Process according to claim 9, characterized in that the proportion of water incorporated into the gas oil is from 100 to 1000 ppm in conjunction with 25 to 2000 ppm of surfactant accompanied by 0.5 to 1 part by weight of co-surfactant.

11. Process according to claim 1 or 2, characterized in that the surfactant is an alkali metal sulphonate in which the group:

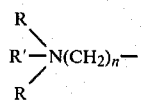

is an aliphatic or alkyl-aryl hydrocarbon chain.

12. Process according to claim 11, characterized in that the surfactant is an alkali metal sulphosuccinate.

13. A gas oil composition comprising hydrocarbons boiling between 200° and 425° C., having improved combustion properties, which contains 100 to 5000 ppm of emusified water and 10 to 5000 ppm of at least one surfactant of the formula

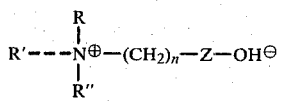

wherein Z represents CO or $SO_2$, n is an integral number from 1 to 6, R is an alkyl group or a hydrogen atom, R′ is an alkyl or alkenyl group, a hydrogen atom or an acyl group, while R″ is methyl or is absent or a salt thereof.

14. Composition according to claim 13, characterized in that the water it contains is in the form of particles having dimensions less than 0.4 micron.

15. Process according to claim 2 characterized in that R is a $C_1$ to $C_4$ alkyl group.

16. Process according to claim 3 characterized in that R′ is a $C_1$ to $C_{18}$ alkyl or alkenyl group.

17. Process according to claim 7 characterized in that said cosurfactant is a $C_1$ to $C_5$ alcohol.

18. The process according to claim 17 characterized in that said co-surfactant is butanol and characterized in that said surfactant is sodium coco-sarcosinate.

* * * * *